US006322399B1

(12) United States Patent
Hanning

(10) Patent No.: US 6,322,399 B1
(45) Date of Patent: Nov. 27, 2001

(54) ELECTRICAL MODULE HAVING COUPLING MEANS

(75) Inventor: Walter Hanning, Detmold (DE)

(73) Assignee: Weidmiller Interface GmbH & Co., Detmold (DE)

( * ) Notice: Subject to any disclaimer, the term of this patent is extended or adjusted under 35 U.S.C. 154(b) by 0 days.

(21) Appl. No.: 09/662,353

(22) Filed: Sep. 14, 2000

(30) Foreign Application Priority Data

Sep. 16, 1999 (DE) ..... 299 16 303 U

(51) Int. Cl.[7] ..... H01R 9/22
(52) U.S. Cl. ..... 439/717; 439/406
(58) Field of Search ..... 439/716, 717, 439/709; 200/303, 307, 318, 294; 361/732, 735

(56) References Cited

U.S. PATENT DOCUMENTS

| | | | | |
|---|---|---|---|---|
| 4,184,733 | * | 1/1980 | Schemeling | 439/717 |
| 4,210,379 | * | 7/1980 | Vachhani et al. | 439/416 |
| 4,591,228 | * | 5/1986 | Vasseur | 439/717 |
| 4,729,744 | * | 3/1988 | Bet et al. | 439/717 |
| 5,411,417 | | 5/1995 | Horn et al. . | |
| 5,588,881 | | 12/1996 | Eggert et al. . | |
| 5,629,831 | | 5/1997 | Eggert et al. . | |

FOREIGN PATENT DOCUMENTS

| | | | |
|---|---|---|---|
| 3829421 A1 | | 3/1990 | (DE) . |
| 4331212 A1 | | 3/1995 | (DE) . |
| 19748530 C1 | | 2/1999 | (DE) . |
| 19807710 A1 | | 9/1999 | (DE) . |
| 709933 B1 | | 11/1999 | (EP) . |
| 1294828 | * | 11/1972 | (GB) 439/717 |

* cited by examiner

*Primary Examiner*—Paula Bradley
*Assistant Examiner*—Larisa Tsukerman
(74) *Attorney, Agent, or Firm*—Lawrence E. Laubschein

(57) ABSTRACT

A terminal block assembly includes a first latching arrangement for connecting a pair of parallel terminal blocks at adjacent first ends in side-to-side contiguous relation, the latching arrangement being automatically disengaged when first adjacent ends of the terminal block are manually separated. At the other adjacent ends of the pair of terminal blocks, a conventional second latching arrangement is provided that requires operation by a release tool that is introduced within the terminal block via an access opening contained therein.

6 Claims, 8 Drawing Sheets

ELECTRICAL MODULE HAVING COUPLING MEANS

FIELD OF THE INVENTION

A terminal block assembly includes a plurality of terminal blocks arranged in parallel side-to-side relation transversely of a support rail upon which the terminal blocks are mounted, characterized by the provision of latch means for connecting together successive pairs of the terminal blocks, said latch means being automatically disengaged without the use of any latch releasing tool merely by separating one pair of adjacent ends of the terminal blocks.

BACKGROUND OF THE INVENTION

BRIEF DESCRIPTION OF THE PRIOR ART

It is well known in the patented prior art to mount a plurality of terminal blocks on a common support rail, as evidenced by the to Horn, et al., U.S. Pat. No. 5,411,417, Eggert, et al., U.S. Pat. No. 5,588,881, and Eggert, et al., U.S. Pat. No. 5,629,831, among others, and the European patent No. EP 95 113 730 A1. The terminals carried by the terminal blocks serve various functions, said as bus bars for supplying electrical power to the terminal blocks, grounding connections to the grounded support rail, and signal terminals for supplying control signals to and from modules mounted on associated with the terminal blocks.

It has also been proposed in such terminal block assemblies to latch together successive pairs of the terminal blocks, thus improve the rigidity of the assembly and thereby prevent electrical separation of the components upon the application of impact or shock forces to the assembly. In the known latching devices, the use of a release tool inserted through an access opening is often required to disconnect the latch. One drawback to this arrangement is that at certain crowded regions of the terminal blocks, for example, the end portions that contain a large number of terminals, it is not possible to provide access openings for introducing a latch releasing tool.

SUMMARY OF THE INVENTION

Accordingly, a primary object of the present invention is to provide a terminal block assembly including a plurality of terminal blocks that are adapted for transverse mounting in a parallel side-by-side manner on a support rail, including novel first latch means that serve to fasten together successive pairs of terminal blocks, said latch means being automatically disengaged without the use of any disengaging tool merely by manually separating one adjacent pair of ends of the terminal block pair.

Accordingly, to another object of the invention, the latch means of the present invention may be used in conjunction with conventional tool-released latching means that are arranged between the first latch means and the ends of the terminal blocks that are to be manually separated.

According to a more specific member, each of the first latch members extends from the entrance of a first latch opening through the first terminal block and laterally outwardly from the opposite side of the first terminal block into the entrance of a corresponding latch opening contained in an adjacent second terminal block. The latch member extends into the second terminal block a distance equal to at least one-half the thickness of the second terminal block, said latch member being cammed into latched engagement with a keeper surface on the second terminal block by a cam surface on the latch member of the second terminal block.

BRIEF DESCRIPTION OF THE DRAWINGS

Other objects and advantages of the invention will become apparent from a study of the following specification when viewed in the light of the accompanying drawings, in which.

DETAILED DESCRIPTION

Figure 1:
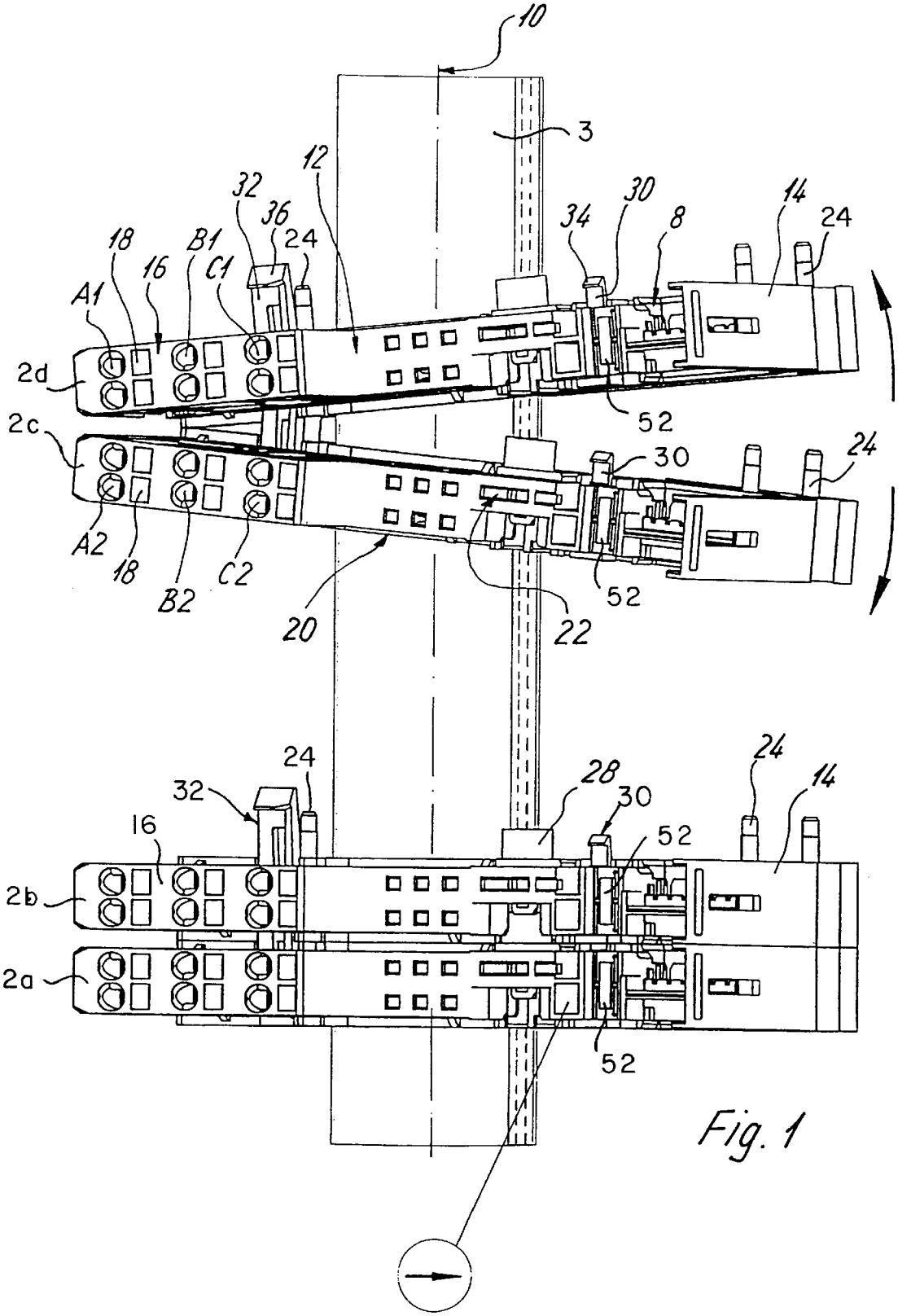
FIGS. 1 and 2 are top plan and side perspective views, respectively, of the terminal block assembly of the present invention.
Figure 2:
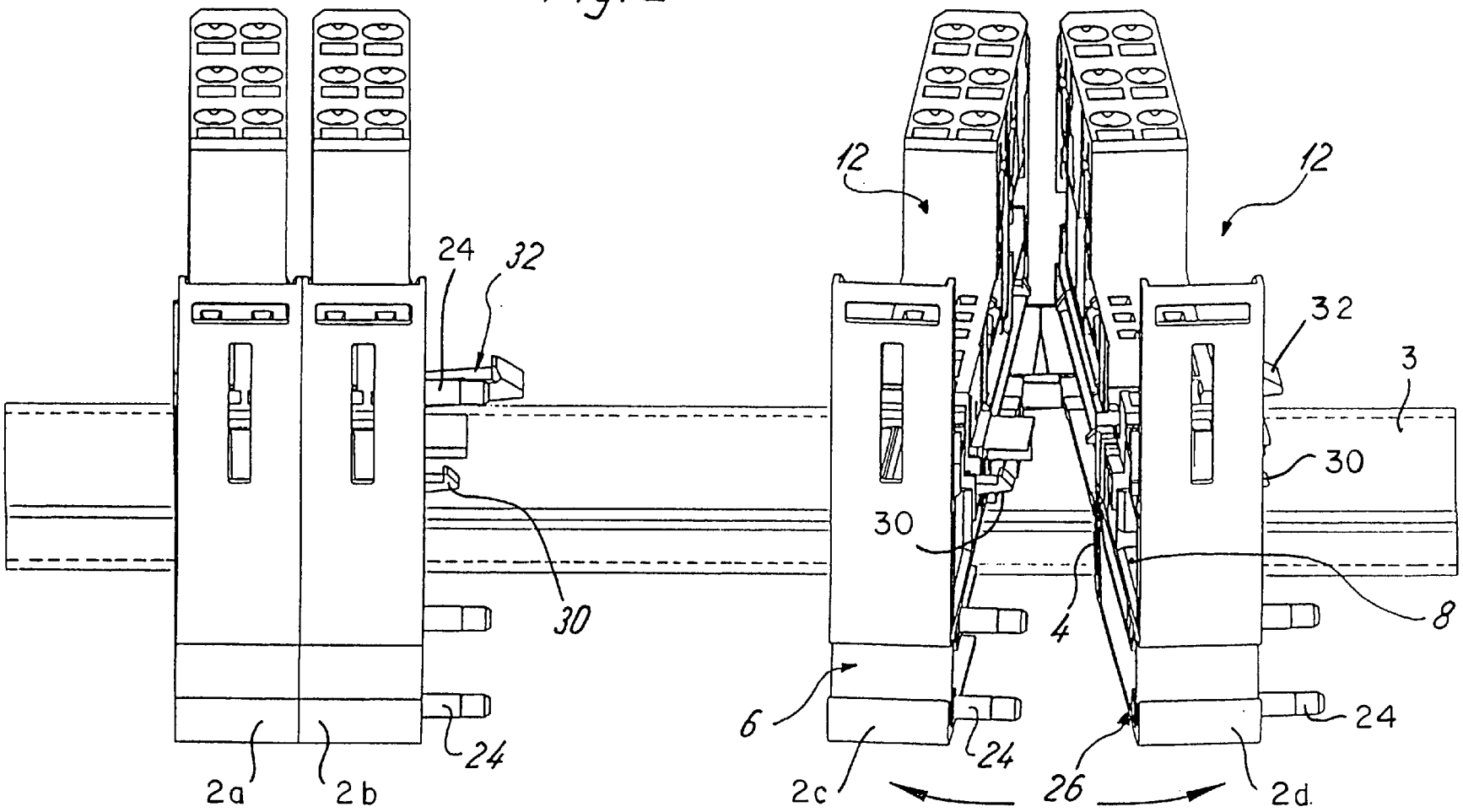

Referring first more particularly to FIGS. 1 and 2, the terminal block assembly of the present invention includes a plurality of terminal blocks 2*a*, 2*b*, 2*c*, 2*d* that are releasably mounted in a transverse manner across the rail 3 by mounting feet 4 (FIG. 2). As shown in FIG. 2, each terminal block has a lower portion 6 that carries the conventional mounting feet 4, and an upper portion containing a bus conductor opening 8 (FIG. 1) extends through the terminal blocks of the assembly to afford a path for receiving a common bus bar conductor (not shown). One end 16 of the terminal block is provided with a plurality of electrical contacts (A1, A2, B1, B2, C1, C2) that are adapted for electrical connection with conductors by means of screwdriver tool means that extend through openings 18 adjacent the various electrical contacts. A recess 12 is provided intermediate the ends of the terminal blocks for receiving various electrical components, such as printed circuit boards, sensor modules, or the like. A plurality of openings associated with the connections 20 permit the passage of conductors vertically through the top body wall of the terminal block.

In accordance with a characterizing feature of the present invention, novel latch means are provided for rigidly laterally connecting the side-by-side terminal blocks, thereby to rigidly and protectively connect the components, which otherwise might be inadvertently separated by shaking stresses or machinery controls. The terminal blocks are provided with laterally projecting guide pins 24 that are tapered in the direction of their free ends for insertion within corresponding guide openings 26 (FIG. 2) contained in the adjacent side wall of the next terminal block. These guide pins insure that the terminal blocks have the desired aligned side-by-side relationship, whereby bridging components (not shown) that would bridge the respective contacts B1 and B2, for example, would be properly oriented relative to each other. In order to releasably fasten together successive pairs of the terminal blocks, each terminal block is provided with a pair of longitudinally spaced latch members 30 and 32 (FIG. 3) that extend within corresponding latch openings 38 and 40 contained in the adjacent side of the adjacent terminal block. The latch member 30 of the first terminal block 2*a* is conventional and includes an enlarged hook portion 34 which carries a transverse latch surface arranged to engage the keeper surface 48 adjacent the opening 38 contained in the second terminal block 2*b*. The latch member 30 is normally resiliently biased upwardly toward the latched position. Access openings 52 are provided above the latch members 30 for receiving release tool means, such as a screwdriver, that displaces the latch member 30 downwardly to disengage the transverse latch surface on the hook portion 34 from the adjacent keeper wall surface 48, thereby to permit separation of the associated ends of the terminal blocks, as shown for example by the terminal blocks 2*c* and 2*d* in FIGS. 1 and 2.

Figure 3:
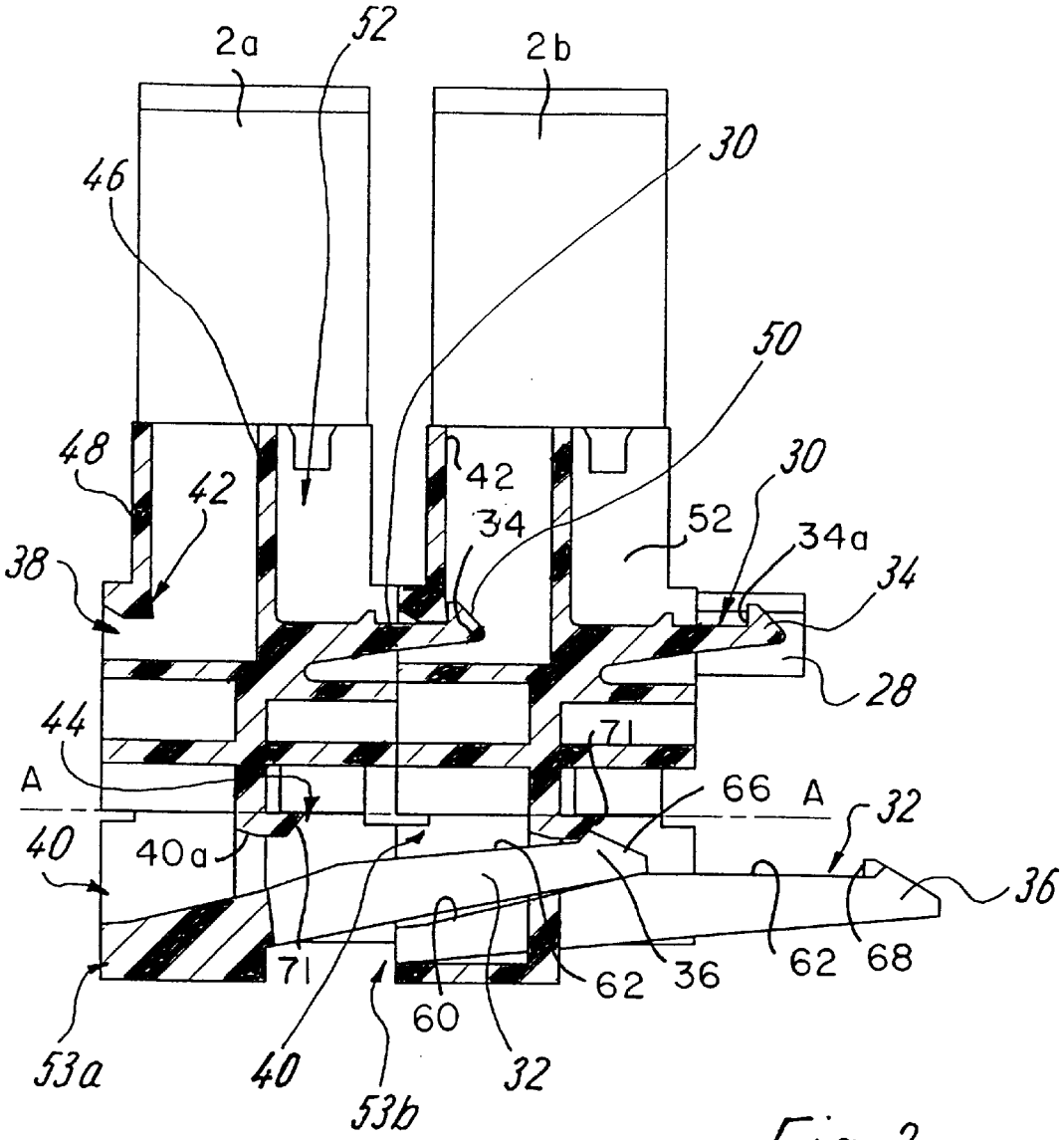
FIG. 3 is a detailed sectional view, offset along line A—A, of a pair of terminal blocks when in the double latched condition.

In accordance with a characterizing feature of the present invention, the latch hook means 32 that connect the other ends of the terminal blocks adjacent the terminal contact portions 16 thereof are of such construction that they may be disengaged without the use of any disengaging tool means. More particularly, as best shown in FIG. 3, each of the projections 32 begins at a latching opening 40 contained in one side wall of the terminal and extends completely through the terminal block and over at least one half the thickness of the next terminal block 2*b*. At its free end, the latch 32 is provided with an enlarged head portion 36 that carries a transverse latch surface 68 (best shown in FIG. 6*a*) that is arranged to engage a corresponding keeper surface 44 on the associated terminal block 2*b*. In this manner, the ends of the terminal blocks adjacent the connecting portion 16 are fastened together by the latch hooks 32.

Figure 4B:
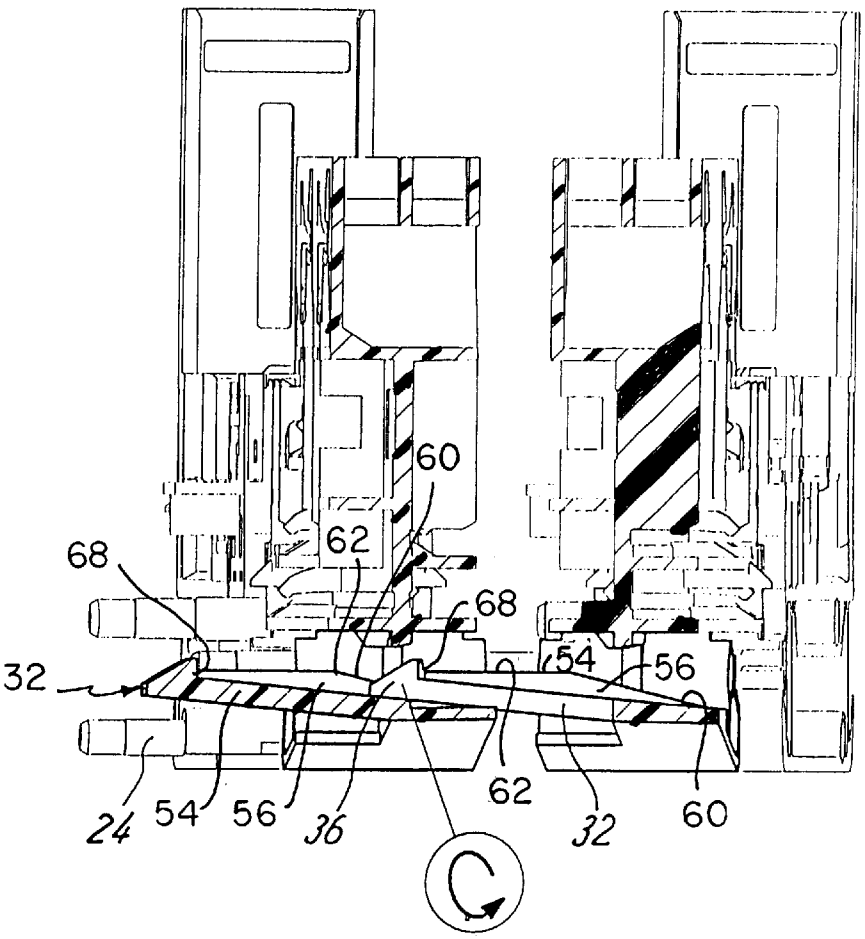
FIG. 4*b* is a partially exploded view of the terminal blocks in the unlatched condition.
Figure 4A:
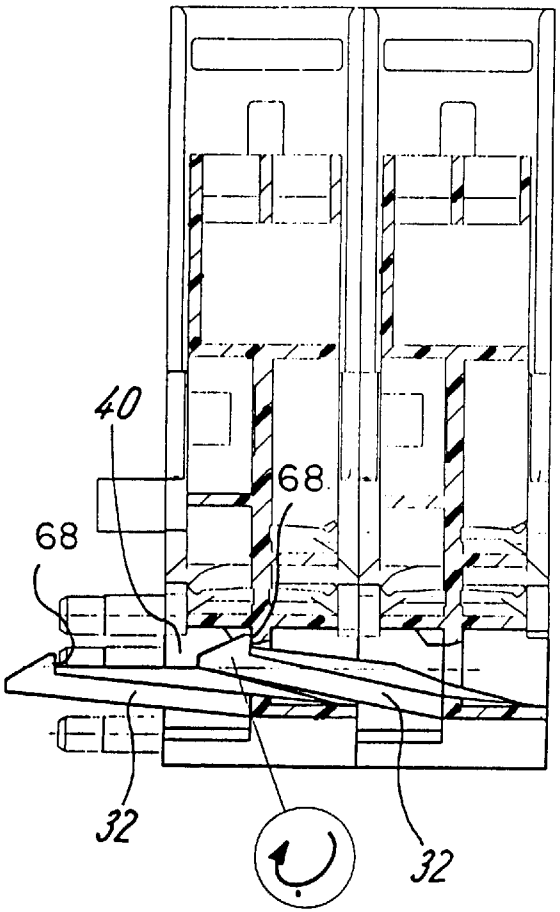
FIG. 4*a* is a transverse sectional view of a pair of terminal blocks when in the latched condition.
Figure 5A:
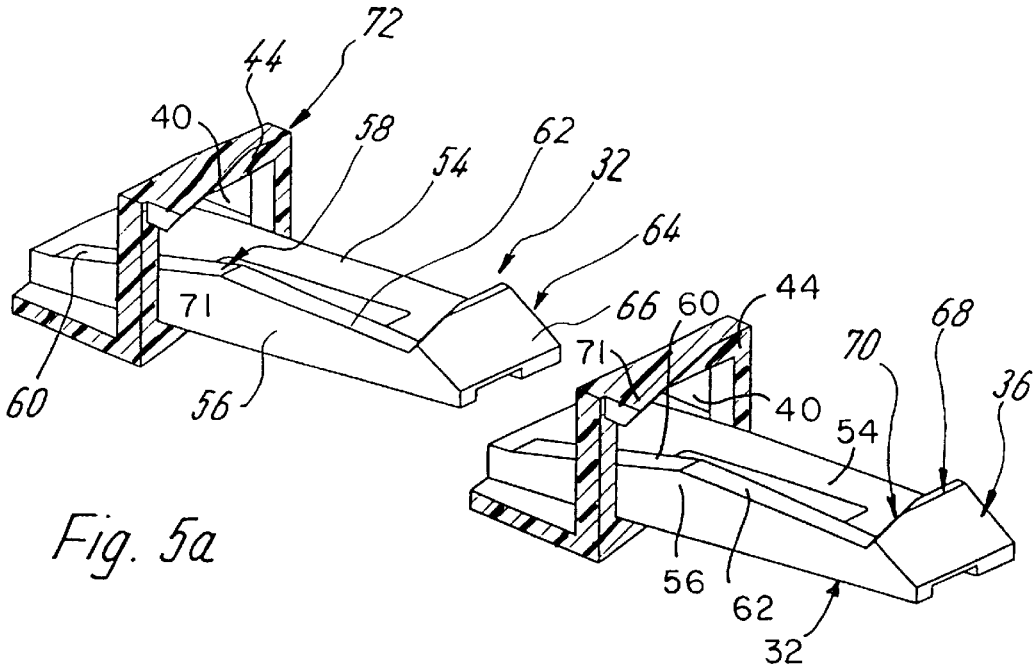
FIG. 5*a* is an exploded detailed perspective view of a pair of latch members in the disconnected condition.
Figure 5B:
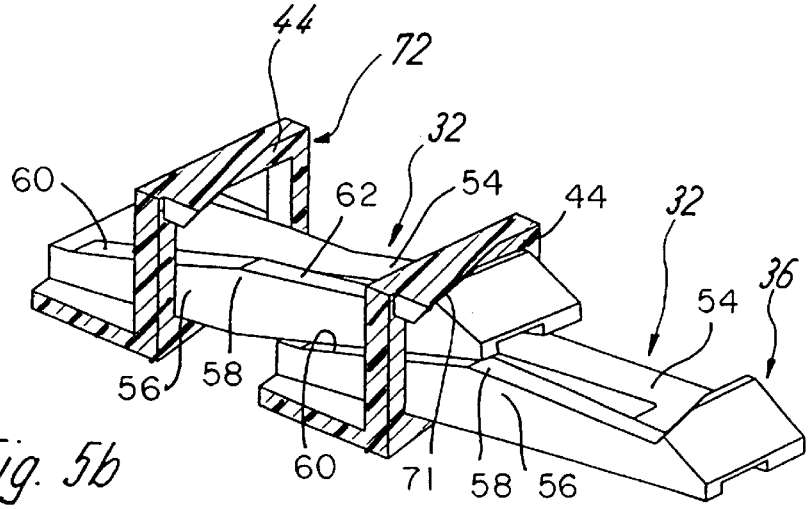
FIG. 5*b* illustrates the latch members when in the latched condition.
Figure 6A:
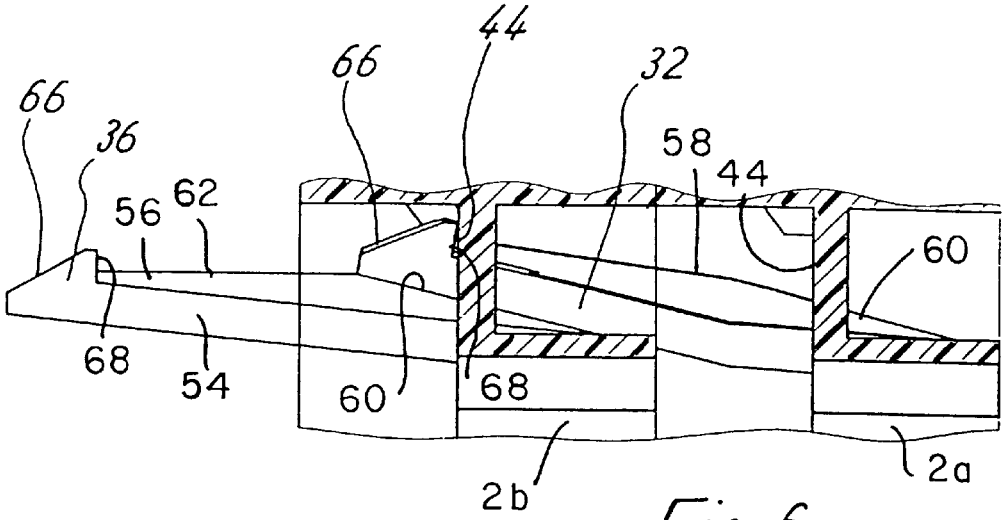
FIG. 6*a* and 6*b* are detailed vertical and horizontal sectional views, respectively, of a latch member in the latched condition.
Figure 6B:
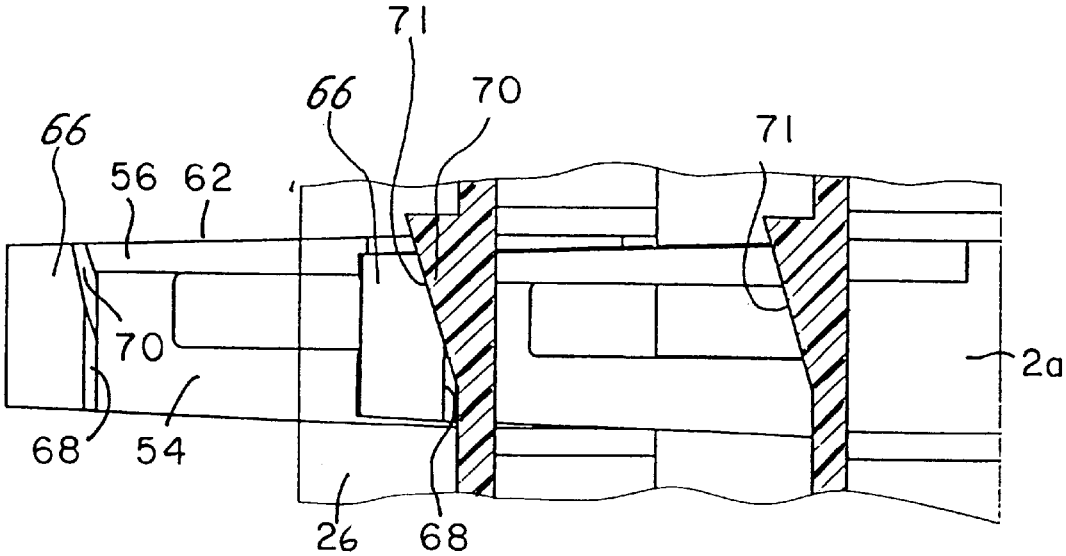

As shown in FIGS. 3, 5*a*, and 6*a*, the latch member 32 normally extends generally horizontally from one side wall of the terminal block into a corresponding latch opening 40 contained in the adjacent wall of the adjacent terminal block. As shown in FIGS. 5*a* and 5*b*, the latch projections 32 have a generally L-shaped cross-sectional configuration, thereby to define a generally horizontal base body portion 54, and a vertical portion 56 that upper edge of which is provided with a cam surface 58 having an inclined ramp portion 60 adjacent the associated latch opening 40, and a downwardly extending inclined portion 62 that extends generally parallel with the guide rail 3. As shown in FIG. 4*b*, when the latch member 32 is introduced within the adjacent latch opening 40, the lower surface of the latch member rides upwardly on the ramp surface 60, thereby to elevate the latch member 32 toward the latched position of FIG. 3, wherein the transverse latch surface 68 (FIG. 6*a*) becomes latched to the keeper surface 44.

According to an important feature of the invention, when the first pair of ends are separated as shown in FIGS. 1 and 2, the latch member 32 is automatically progressively disengaged from the associated keeper surface 44. More particularly, the latch member 32, which is inherently resiliently biased toward the disengaged position, progressively slides down the ramp surface 60 to disengage the latch surface 68 from the keeper surface 44. In accordance with a more specific feature of the invention, a pair of release surfaces 70 and 71 are provided on the latch hook portion 36 and the keeper surface 44, respectively, thereby to insure final release of the latch member 32 from the associated keeper surface 44.

Figure 7A:
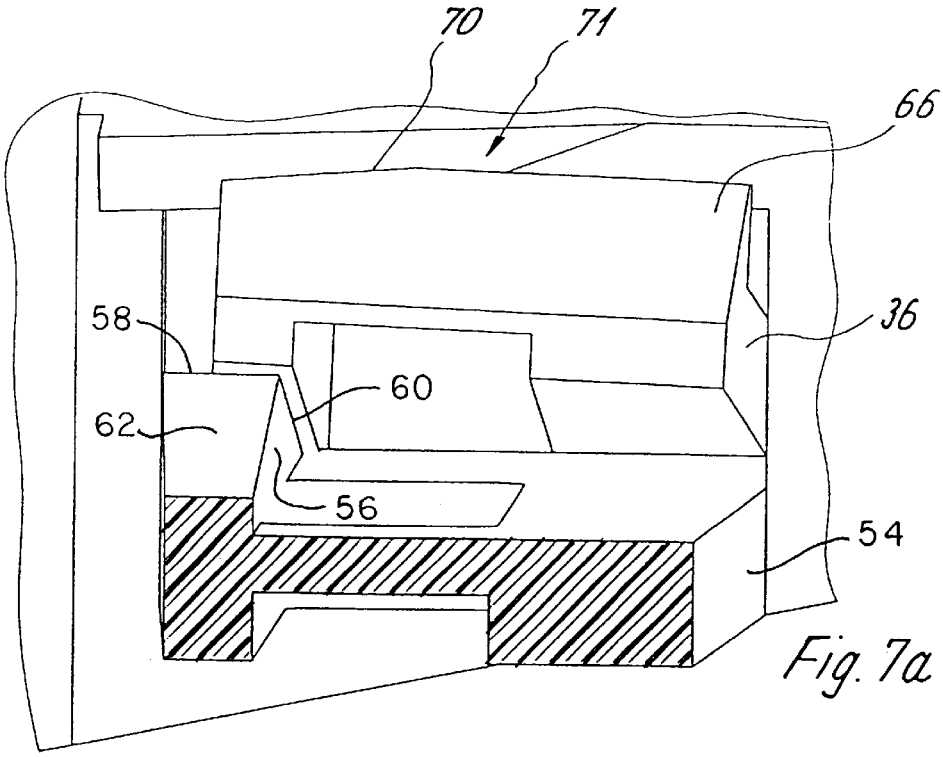
FIG. 7*a*–7*c* are detailed perspective sectional views illustrating the release surfaces associated with the latch members.
Figure 7B:
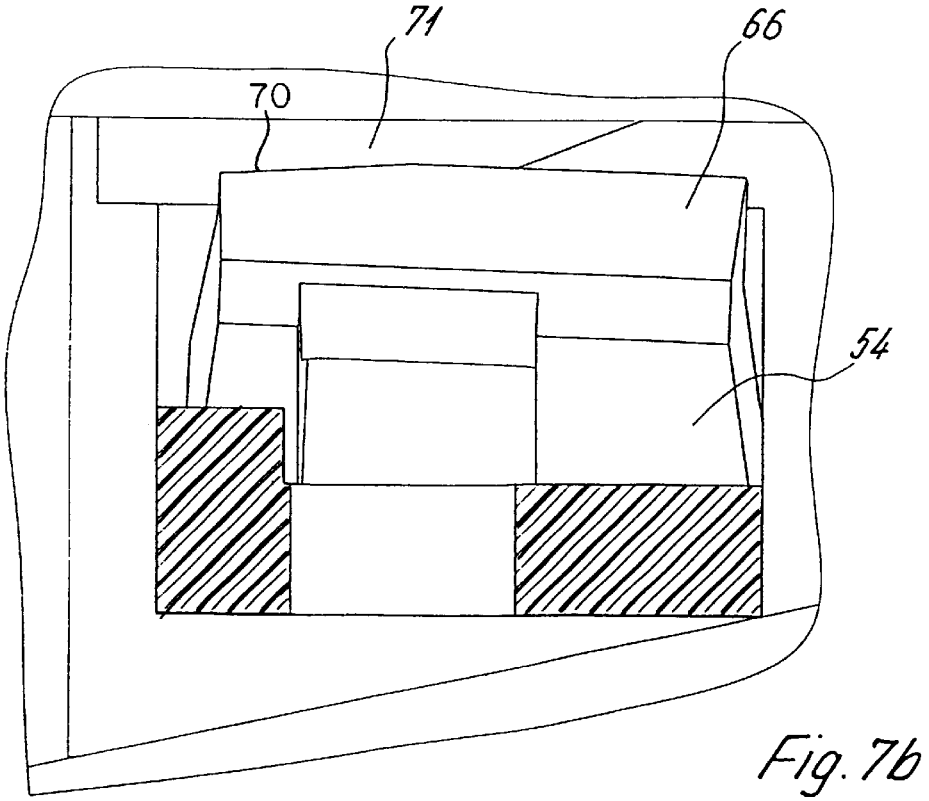
Figure 7C:
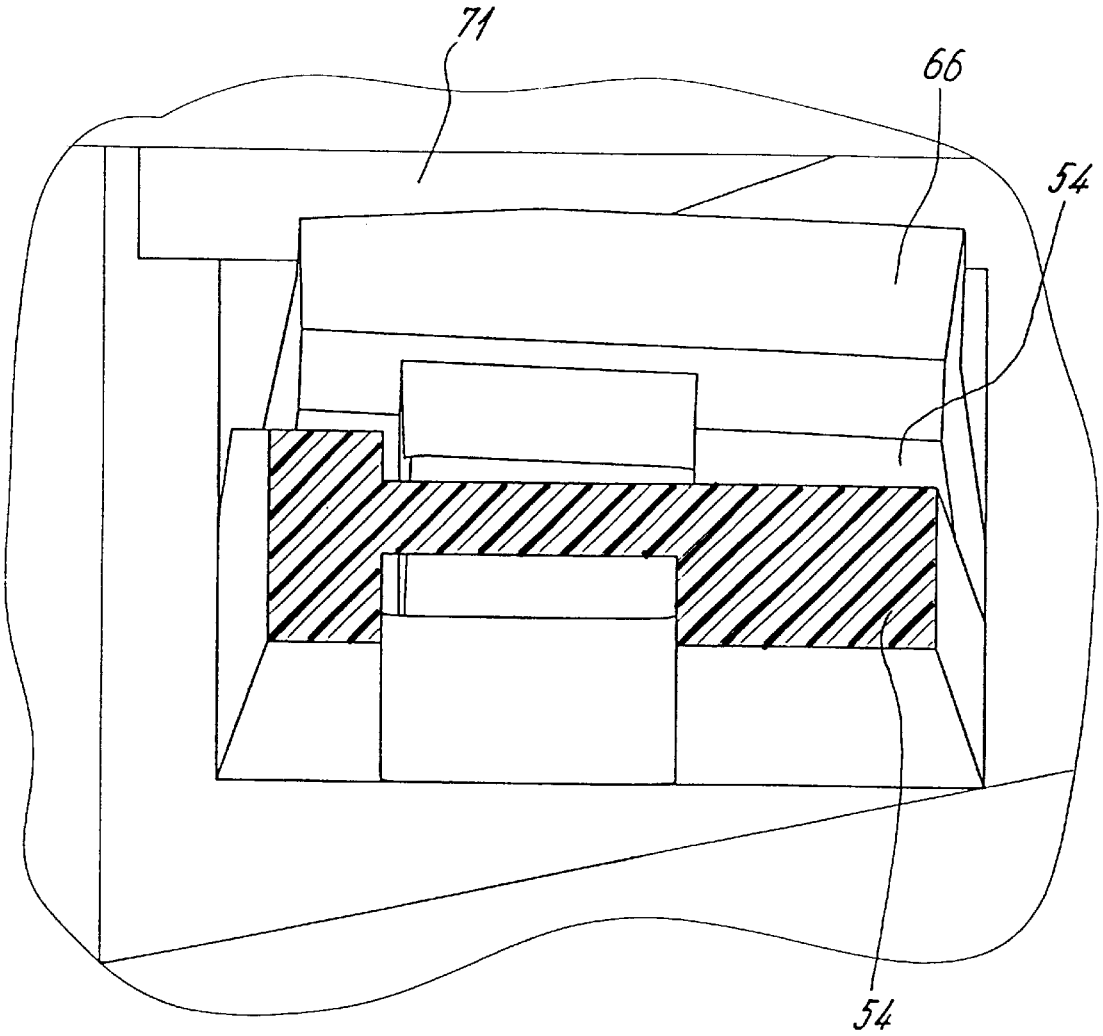

Referring to FIGS. 7*a*–7*c*, it will be noted that as the latch member 32 is progressively elevated by the ramp surface 60 on the cam means 58, it is accompanied by a certain degree of twisting distortion about its axis. This twisting distortion tends to bias the latch member toward the released condition, thereby to further insure release of the latch member from its keeper surface 44.

In operation, in order to fasten a pair of terminal blocks 2*a* and 2*b*, the parallel terminal blocks are laterally displaced toward each other, whereupon the latch member 30 will extend within the opening 38 to permit latching of the head portion 34 with the keeper surface 48 on the adjacent terminal block, respectively. Similarly, as the latch member 32 of terminal block 2*a* is introduced within the latch opening 40, of the associated terminal block 2*b*, the latch member 32 rides upwardly on the ramp surface 60 and is displaced toward its latched position in engagement with the keeper surface 44 of the adjacent terminal block, thereby to connect the terminal blocks together.

In order to disengage the terminal blocks, a release tool such as a screwdriver is introduced downwardly into the access opening 52, thereby to displace the latch member 30 downwardly toward a released lower position relative to the keeper surface 42. The associated ends of the terminal blocks are then manually separated as shown in FIGS. 1 and 2. Separation of these ends produces automatic disengagement of the latch member 32, since the free end portion thereof progressively slides down the ramp surface 60, owing to the inherent restoring force of the resilient latch member. In order to assure complete disengagement of the latch member 32, the twisting torsion applied to the latch member is relieved, and the release surfaces 70 and 71 cooperate to progressively displace the end of the latch member 32 downwardly toward the disengaged position. Thus, the latch member 32 is completely disengaged by the manual separation of the terminal blocks, and without the use of any auxiliary release tool means.

While in accordance with the provisions of the Patent Statutes the preferred form and embodiment of the invention have been illustrated and described, it will be apparent to those skilled in the art that various changes may be made without deviating from the inventive concepts set forth above.

What is claimed is:

1. A terminal block assembly including a plurality of parallel electrical terminal blocks arranged in transverse side-by-side relation on a support rail (3), comprising:

(a) at least two terminal blocks (2) adapted for mounting in adjacent parallel side-by-side relation above, and extending transversely of, the guide rail; and (b) first fastening means for fastening said terminal blocks in lateral contiguous engagement, including:

(1) a first latch member (32) connected with a first one of said terminal blocks and extending orthogonally from one sidewall thereof into a corresponding first latch opening (40) contained in the adjacent sidewall of the second one of said terminal blocks, said first latch member having a free end portion provided with an enlarged hook portion (36) having a transverse first latch surface (68);

(2) means defining on said second terminal block adjacent said first opening a first keeper surface (44) arranged for engagement by said latch surface; and (3) means for displacing said first latch member from a disengaged position remote from said first keeper surface toward an engaged position in which said latch surface is in engagement with said keeper surface, thereby to prevent separation of said terminal blocks in a direction normal to the parallel orientation of said terminal blocks; and (c) disengaging means operable when said terminal blocks are angularly displaced toward an angular relationship relative to each other, thereby to disengage said latch surface from said keeper surface, thereby to permit separation of said terminal blocks from each other, said disengaging means further includes release means comprising a pair of cooperating parallel release surfaces (70, 71) arranged adjacent and angularly inclined relative to said first latch and first keeper surfaces, respectively, said release surfaces being operable to release said first latch from said first keeper surface upon separation of said one pair of adjacent ends of said terminal blocks.

2. A terminal block assembly including a plurality of parallel electrical terminal blocks arranged in transverse side-by-side relation on a support rail (3), comprising:

(a) at least two terminal blocks (2) adapted for mounting in adjacent parallel side-by-side relation above, and extending transversely of, the guide rail;

(b) first fastening means for fastening said terminal blocks in lateral contiguous engagement, including:

(1) a first latch member (32) connected with a first one of said terminal blocks and extending orthogonally from one sidewall thereof into a corresponding first latch opening (40) contained in the adjacent sidewall of the second one of said terminal blocks, said first latch member having a free end portion provided with an enlarged hook portion (36) having a transverse first latch surface (68);

(2) means defining on said second terminal block adjacent said first opening a first keeper surface (44) arranged for engagement by said latch surface;

(3) means for displacing said first latch member from a disengaged position remote from said first keeper surface toward an engaged position in which said latch surface is in engagement with said keeper surface, thereby to prevent separation of said terminal blocks in a direction normal to the parallel orientation of said terminal blocks; and (c) disengaging means operable when said terminal blocks are angularly displaced toward an angular relationship relative to each other, thereby to disengage said latch surface from said keeper surface, thereby to permit separation of said terminal blocks from each other, said disengaging means being operable when a first pair of adjacent ends of said terminal blocks are manually separated, the opposite ends of said terminal blocks remaining adjacent each other;

(d) said first latch member having a length that is greater than one half the thickness of said second terminal block, said first latch member extending from the entrance of the first latch opening contained in said first terminal block completely through said first terminal block and into said second terminal block at least one-half the width thereof, said first latch member being resilient and normally biased toward a generally horizontal disengaged position, said first latch member having a generally L-shaped cross-section defined by a pair of orthogonally arranged webs, a first one of said webs (54) comprising a horizontal base web and the a second one of said webs (56) comprising a vertical web that extends upwardly from said base web, said vertical web carrying at its upper surface a cam surface (58) operable to displace said first latch member from said disengaged position upwardly toward said engaged position.

3. A terminal block assembly as defined in claim 2, and further including:

(e) second fastening means longitudinally spaced from said first fastening means for further fastening said terminal blocks together, said second fastening means being arranged intermediate said first pair of terminal block ends and said first fastening means, said second fastening means including:

(1) a resilient second latch member (30) connected with one terminal block and extending laterally from one side thereof into a second opening (38) contained in the adjacent side wall of the other terminal block, said second latch member having at its free end a hook (34) carrying a transverse latch surface (34*a*), said second latch member being normally biased toward a latched position in which said transverse latch surface is in latched engagement with a corresponding keeper surface (48) on said other terminal block adjacent said second opening;

(2) said other terminal block containing an access opening (52) adjacent said second keeper surface affording access to a release tool for manually releasing said second latch member from said second keeper surface, whereby after said second latch is manually released by said release tool, said terminal blocks may be separated at their ends adjacent to effect release of said first latch means.

4. A terminal block assembly as defined in claim 2, wherein said cam surface includes an inclined ramp portion (60) adjacent the entrance of said first latch opening of said first terminal block, and a second cam portion (62) adjacent said associated hook portion, said second cam portion being generally horizontal when said first latch member is in the disengaged condition.

5. A terminal block assembly as defined in claim 4, wherein said associated hook portion includes at its free extremity an inclined insertion surface (66) adapted to guide said hook portion past said associated keeper surface during the insertion of said first latch of one terminal block into said first latch opening contained in the adjacent terminal block.

6. A terminal block assembly as defined in claim 2, and further including a plurality of guide pegs (24) provide on the side wall of each terminal block for engaging corresponding guide holes contained on the adjacent side wall of the adjacent terminal block, said guide pegs being tapered with a decreasing diameter in the direction of their free ends.

* * * * *